US005842430A

United States Patent [19]

Mack

[11] Patent Number: 5,842,430

[45] Date of Patent: Dec. 1, 1998

[54] TUBULAR HOOPING DEVICE FOR EMBROIDERY HOOPS

[76] Inventor: Charles H. Mack, W152 N7406 Westwood Dr., Menomonee Falls, Wis. 53051

[21] Appl. No.: 982,010

[22] Filed: Dec. 1, 1997

[51] Int. Cl.[6] ..... D05C 9/04

[52] U.S. Cl. ..... 112/103; 38/102.2

[58] Field of Search ..... 112/78, 103, 470.14, 112/475.18; 38/102, 102.2, 102.91; 160/380; 33/11, 17 R, 13

[56] References Cited

U.S. PATENT DOCUMENTS

| | | | |
|---|---|---|---|
| 4,762,076 | 8/1988 | Wakaizumi | 38/102.2 X |
| 4,767,111 | 8/1988 | Guenther | 269/303 |
| 4,774,778 | 10/1988 | Williams | 38/102.2 |
| 4,942,683 | 7/1990 | Lawson | 38/102.91 |
| 5,138,960 | 8/1992 | Inteso | 112/103 |
| 5,144,899 | 9/1992 | Allen | 112/103 |
| 5,433,158 | 7/1995 | Moore, III | 112/103 |
| 5,590,613 | 1/1997 | Head | 112/103 |

*Primary Examiner*—Ismael Izaguirre
*Attorney, Agent, or Firm*—Ryan Kromholz & Manion

[57] ABSTRACT

The tubular hooping device for use with embroidery machines is comprised of a support structure, a base plate, a keyed recess, a location device, and an aligning arm. The base plate rests upon the support structure and is arranged to receive a male hoop portion in the keyed recess formed therein. The location device holds a piece of backing material in place over the female hoop portion received in the keyed recess of the base plate. The aligning arm is arranged to receive a male hoop portion and accurately and precisely seat the male hoop portion within the female hoop portion, thereby securing the backing material and a portion of a garment to be embroidered therebetween. The tubular hooping device can be used in a stand alone manner or in conjunction with a hooping rack.

12 Claims, 6 Drawing Sheets

39
20
26
27
26
27
33
35
24
35
31
32
44
5
40
42
44
68
30
80
37a
37
80
34
10
9
8
7
6a
10
6

TUBULAR HOOPING DEVICE FOR EMBROIDERY HOOPS

BACKGROUND OF THE INVENTION

The present invention relates generally to the field of embroidering and specifically to the use of a hooping device to ensure the proper location and alignment of an article of clothing in an embroidery machine.

Embroidery is an attractive and popular method of decorating articles of clothing. It is also an effective and much used method of advertising. The popularity of embroidery and the need to embroider large numbers of garments in a short length of time has spawned the invention of machines able to embroider a plurality of garments at one time.

In like manner to hand embroidery, hoops are used to secure a garment beneath the sewing heads of an embroidery machine. The instant invention is drawn to the use of what are called tubular hoops. In the field of embroidery, the term tubular refers to the configuration of the garment or other workpiece to be embroidered. Shirts, jackets, stockings, caps, sleeves, and the like are considered to be tubular garments. Tubular garments are difficult to embroider, as they tend to be awkward to position in an embroidery machine. To remedy the difficulties inherent in embroidering tubular garments, a system of suspending the portion of the tubular garment to be embroidered beneath a sewing head of an embroidery machine has been developed. This system comprises the use of tubular hoops. Tubular hoops are comprised of a larger and a smaller circular section of a hollow cylinder. The larger hoop is called the female hoop portion and is sized so as to frictionally receive in its inner diameter the smaller hoop, which is called the male portion. The hoops are used to secure and to stretch a piece of fabric or a portion of a garment that is to be embroidered. As is well known, the portion of the garment to be embroidered is placed between the male and female hoop portions. Once the portion of the garment to be embroidered is properly framed by the hoop portions, the male hoop portion is seated within the female hoop portion, thereby catching a portion of the garment between the inner diameter of the female hoop portion and the outer diameter of the male hoop portion. The garment is retained between the hoop portions by the friction fit of the hoop portions, the magnitude of the friction force being enhanced by the added thickness of the garment caught therebetween.

It is the practice of the embroidering industry to provide attachment means upon one of the hoop portions, generally the male hoop portion, so as to permit the hoop portions and the garment secured therebetween, to be secured to the embroidery machine for the embroidery operation. This permits a ganged embroidery machine to embroider a number of garments at one time rather than a single garment.

However, a major problem exists in the use of tubular hoops. Because the methods and devices heretofore used for positioning a garment between the male and female hoop portions have been neither accurate nor precise, the number of flawed garments turned out by embroidery machines has been high. Quite often a garment is improperly secured between the male and female hoop portions, resulting in the embroidery being in the wrong position or in being misaligned or skewed. As embroidery is for all intents and purposes permanent, each flawed garment represents a loss to the manufacturer.

Another problem that exists in the process of using tubular hoops in the embroidery process is the amount of time necessary to properly secure a garment between male and female hoop portions. It is difficult and very time consuming to measure by hand the proper positioning and alignment for a hoop on a garment. What is more, when measuring by hand it is very easy to make a mistake. Placing the garment between the hoops by sight is much faster, but results in far more mistakes and incurred cost. The problem with many of the devices of the prior art is that they incorporate far too many steps that are carried out by hand measurement or by sight alone. Not only does using the hooping devices of the prior art require too much time, but there is also a higher risk of error.

It is therefore an object of this invention to provide a device that will permit a user to accurately locate a predetermined portion of a garment between a male hoop portion and a female hoop portion.

It is another object of this invention to provide a device that permits a user to precisely repeat the procedure of accurately locating a predetermined portion of a garment between a male hoop portion and a female hoop portion.

It is another object of this invention to provide a device that will retain a portion of backing material in a predetermined location so as to ensure that the backing material will be secured with the garment between the male and female hoop portions.

It is yet another object of this invention to provide a device that will ensure that the male and female hoop portions are brought into mating contact when pressure is applied to the male hoop portion.

It is yet another object of this invention to provide a device that will ensure that the male and female hoop portions are mated so as to minimize the potential for the garment or hoop portions to interfere with the sewing heads of an embroidery machine.

It is yet another object of this invention to provide a device that will allow a user to ensure that a garment having a pattern or pocket will be properly aligned when placed into the hoop portions.

SUMMARY OF THE INVENTION

The present invention is directed to a tubular hooping device that permits a user to quickly, accurately, and precisely secure a portion of a garment to be embroidered between a male hoop portion and a female hoop portion so that the garment can be mounted adjacent the sewing heads of an embroidery machine for embroidering.

The tubular hooping device disclosed herein is comprised of a support structure, a base plate, a keyed recess, a second recess, a location means, and an aligning arm. The support structure has a bottom and a top, the bottom of the support structure generally being secured to a work surface. The base plate of the tubular hooping device has a proximate end and a distal end and a top side and a bottom side and is comprised of a cantilever portion and an aligning portion, the cantilever portion being arranged to removably support upon its upper surface the aligning portion. The keyed recess is sized to receive a female hoop portion and is formed into the top side of the distal end of the aligning portion of the base plate. The second recess is positioned coaxial to the keyed recess in the top side of the aligning portion. The second recess is sized to receive a male hoop portion, such that the male hoop portion received within the female hoop portion will also be received into the second recess. However, the second recess is also sized so as to prevent the ingress of the female hoop portion.

At least one location means is situated adjacent to the keyed recess so as to retain a portion of a backing material over the female hoop portion received in the keyed recess. The aligning arm has a proximate end and a distal end and is comprised of a first finger and a second finger, joined at their proximate ends by a web. The aligning arm is supported above the base plate and is coupled to the proximate end of the aligning portion of the base plate at the web. The first finger and the second finger are each provided with a positioning block arranged so as to form a slot on the distal side of the positioning block. Each finger is also provided with a positioning structure mounted distal to each positioning block. The positioning block and the positioning structure are arranged to receive a connecting means of a male hoop portion so as to removably secure the male hoop portion to the aligning arm and bring the male hoop portion into mating contact with the female hoop portion without removing the male hoop portion from the aligning arm.

The support structure of the tubular hooping device may have an angle iron affixed to the proximate end of the top of the support structure so as to form a slot capable of receiving the proximate end of the cantilever portion of the base plate. Furthermore, the base plate may have a second slot formed into the center of its proximate end to receive a slot pin that is affixed to the support structure between the angle iron and the top of the support structure. The cantilever portion of the base plate is arranged to be removably secured to the top of the support structure by a machine screw passed through the cantilever portion of the base plate and threadedly received by a hole in the top of the support structure. The aligning portion of the base plate is removably securable to the upper surface of the cantilever portion by at least two locating pins that are affixed to and depend from the lower surface of the aligning portion. The locating pins of the aligning portion are received in at least two locating holes formed into the upper surface of the cantilever portion.

In the alternative, the tubular hooping device may further comprise a support structure having a bottom and a top, the bottom of the support structure being secured to a work surface, the top surface being arranged to support a hooping rack. The hooping rack of the present alternative embodiment has a plurality of locating holes bored into the surface thereof in a plurality of predetermined positions. The locating holes are arranged to receive at least two locating pins that extend from the bottom side of the aligning portion. The combination of the locating pins and the locating holes permit the aligning portion to be positioned in any of a plurality of predetermined positions defined by the locating holes.

The locating means generally comprises a bottom plate and a top plate that are connected by a hinge. The bottom plate is affixed to the base plate immediately adjacent the keyed recess and the top plate is hinged to the bottom plate along a substantially linear first edge of each plate. The first edge of each plate is located away from the keyed recess to permit the location means to open away from the keyed recess. Each plate has a second edge, the profiles of which are substantially identical. In addition, the profiles of the second edges of the plates are substantially identical to the profile of the edge of the keyed recess. The second edges of the top and the bottom plates are substantially collinear with the edge of the keyed recess.

The bottom plate and the top plate can be magnetically attracted to one another, or they may be biased into contact with one another by a spring means coupled between the top and the bottom plate. In either case a portion of backing material may be retained between the bottom plate and the top plate by friction forces created by the magnetic forces or the spring means holding the top plate to the bottom plate.

A method for properly aligning a portion of a garment to be embroidered between a male hoop portion and a female hoop portion is also disclosed. A female hoop portion is placed in the keyed recess of the tubular hooping device and a portion of backing material is secured over the female hoop portion received in the keyed recess of the tubular hooping device using at least one location means. The location means are affixed to the aligning portion of the base plate of the tubular hooping device immediately adjacent the keyed recess. Next, the portion of the garment to be embroidered is arranged over the female hoop portion and the straight edge device is mounted upon the aligning arm of the tubular hooping device. The straight edge device is used to point out the center of the female hoop portion and to create a vertical and a horizontal reference against which a user of the tubular hooping device can compare the alignment of the portion of the garment to be embroidered. The portion of the garment to be embroidered is adjusted over the female hoop portion to a position in which the portion of the garment to be embroidered is properly centered with respect to the center point indicated by the straight edge device and aligned with the horizontal and the vertical references of the straight edge device. The straight edge device is removed from the aligning arm of the tubular hooping device. The male hoop portion is then mounted upon the aligning arm of the tubular hooping device pressure is applied to securely seat the male hoop portion within the female hoop portion. The portion of the garment to be embroidered and the portion of backing material is thereby secured between the male hoop portion and the female hoop portion, the portion of the garment to be embroidered being properly centered and aligned within the male and female hoop portions.

The straight edge device is useful for determining whether a portion of a garment to be embroidered is centered within a male and a female hoop portion and whether the portion of the garment to be embroidered is properly aligned within the male and the female hoop portion. The straight edge device is comprised of a substantially flat rectangular body having two linear parallel longitudinal sides and a first end and a second end. The body of the straight edge device also has means for mounting the body upon the aligning arm of the tubular hooping device. The mounting means comprise an edge capable of being received in the slot formed by the aligning blocks affixed to the aligning arm of the tubular hoop device and at least one hole arranged to receive at least one positioning pin affixed to the aligning arm of the tubular hooping device. The straight edge device also has a plurality of registration marks inscribed upon its body. At least one of the registration marks indicates the location of the center of the portion of the garment to be embroidered. At least one other registration mark creates a horizontal reference and yet another registration mark creates a vertical reference. The center, horizontal, and vertical references are useful for determining whether the portion of a garment to be embroidered is properly aligned.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
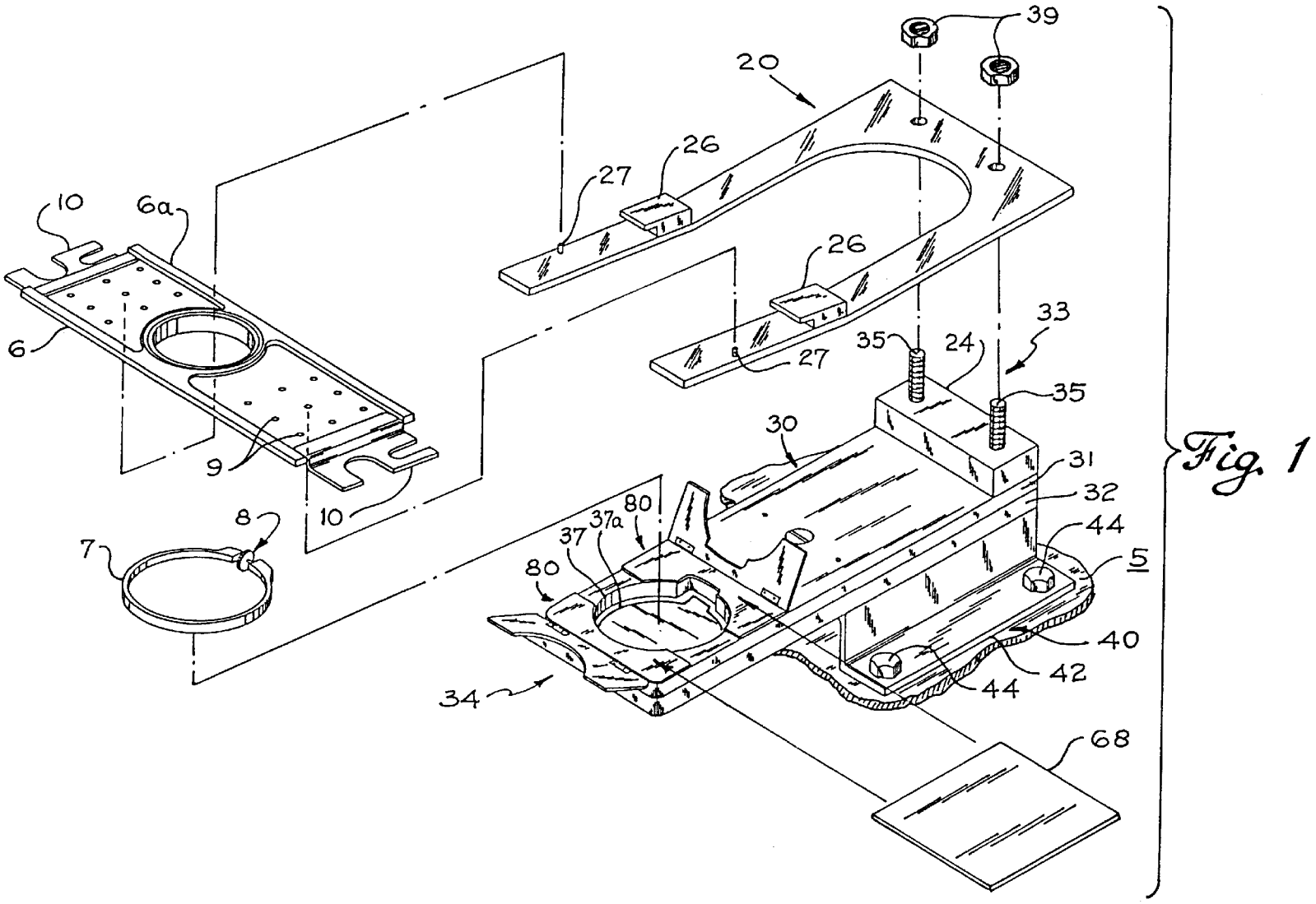
FIG. 1 is an exploded view of the tubular hooping device.

The present invention provides a reliable and efficient means for securing a garment to be embroidered between a male hoop portion 6 and a female hoop portion 7. As seen in FIG. 1, the tubular hooping device 15 is essentially comprised of a flexible aligning arm 20 mounted to a base plate 30. The aligning arm 20 and the base plate 30 are, in this embodiment, mounted upon a support structure 40.

In the embodiment of FIG. 1, the support structure 40 is comprised of a steel bracket 42 affixed to a work surface 5 by fasteners 44. Fasteners 44 are in this case steel bolts but could also be lag screws, wood screws, nails or other suitable fasteners. It should be understood that the particular support structure 40 described herein may have numerous equivalents, all of which are within the scope of the instant invention.

Figure 5:
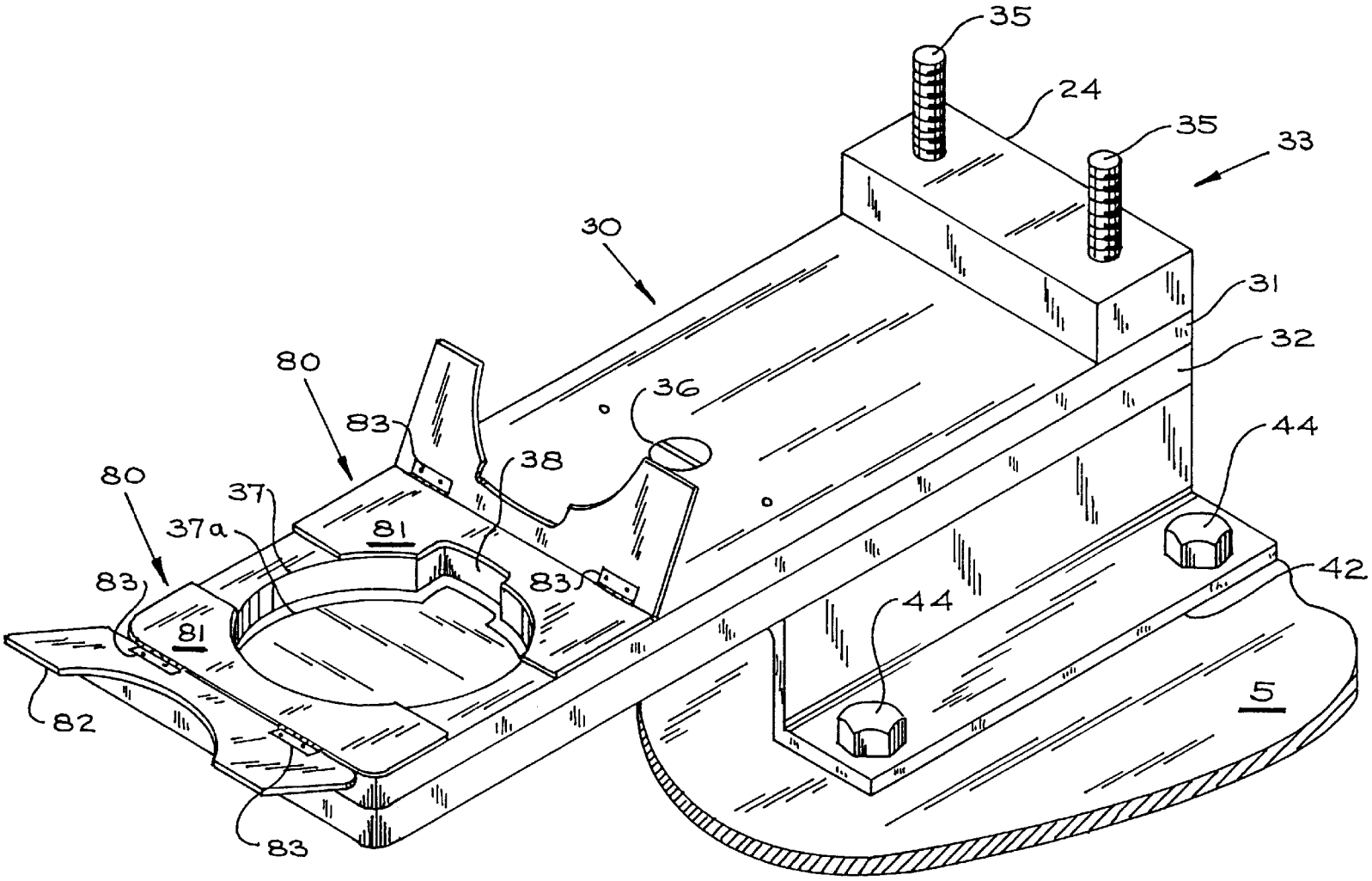
FIG. 5 is a close up view of the backing material location means.

The base plate 30 of the embodiment shown in FIG. 1 is comprised of an aligning portion 31 and a cantilever portion 32. The aligning portion 31 is supported upon the cantilever portion 32. In this embodiment the aligning portion 31 and the cantilever portion 32 have substantially identical profiles, though it is to be understood that the portions 31 and 32 need not have identical profiles. In the embodiment of FIGS. 1 and 5, the aligning portion 31 is supported by and secured with the cantilever portion 32 to the support structure 40 by a counter sunk machine screw 36. Bolts 35 may also be used to secure the aligning portion 31 and the cantilever portion 32 of the base plate 30 to the support structure. It should be noted that the bolts 35 and the machine screw 36 may work together or independently to secure the aligning portion 31 and cantilever portion 32 to the support structure 40.

Figure 3:
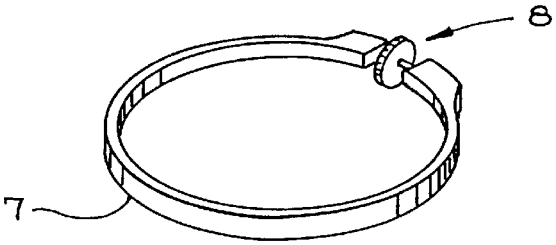
FIG. 3 is a female portion of a typical tubular hoop.

As can be seen in FIGS. 1, 3 and 5, the aligning portion 31 has a keyed recess 37 formed into its distal end 34. The keyed recess 37 is shaped so as to receive a typical female hoop portion 7. A notch 38 cut into the proximal end of the recess 37 is sized so as to receive an aligning and adjusting means 8 of the female hoop portion 7. The aligning and adjusting means 8 allows the nominal diameter of the female hoop portion to be altered to account for various thickness of materials to be embroidered or to adjust the amount of force necessary to seat the male hoop portion 6 within the female hoop portion 7. The aligning and adjusting means 8 also allows the female hoop portion 7 to be positively oriented within the keyed recess 37. In addition, the cantilever portion 32 has a second recess 37*a* positioned coaxially with keyed recess 37 of the aligning portion 31. The second recess 37*a* is smaller than the keyed recess 37, permitting the female hoop portion 7 to be supported upon the cantilever portion above the second recess 37*a*. However, it is critical that the second recess 37*a* be large enough to receive the male hoop portion 6 so that the male hoop portion 6 can be inserted through the female hoop portion 7. In this arrangement it is possible, and preferred, for a portion of the male hoop portion 6 to extend all the way through and a bit beyond the female hoop portion 7.

In embroidering garments it is not desirable to embroider a single thickness of fabric. Rather, it is the industry practice to place a piece of backing material 68 behind the particular portion of a garment that is to be embroidered. The backing material 68 serves to strengthen the fabric being embroidered. In order to ensure that the backing material 68 is located behind a particular portion of a garment to be embroidered, at least one location means 80 has been provided on the distal end of the aligning portion 31, immediately adjacent the keyed recess 37. In this embodiment, the alignment means comprises a magnetic bottom plate 81 hinged to a magnetic top plate 82. It is to be understood that only one of the bottom or top plates 81 and 82 need be magnetic, so long as the magnetic force generated between plates 81 and 82 is sufficient to maintain the backing material 68 in its desired position. The hinges 83 can be of any useful type such as a piano hinge or a fabric hinge made of an adhesive fabric tape. The bottom and top plates 81 and 82 have substantially identical profiles that are shaped so as to conform to the shape of the keyed recess 37. The location means 80 is arranged to hold the backing material 68 in place over the keyed recess 37 by magnetically induced friction forces. In normal operation, a female hoop portion 7 is placed in the keyed recess 37. The top plates 82 of the location means 80 are rotated away from the bottom plates and a single sheet of backing material 68 is placed over a female hoop portion 7 that is received by the keyed recess 37 such that a portion of the backing material 68 lies over the bottom plates 81. The top plates 82 of the location means 80 are then rotated into contact with the backing material 68. The magnetic attraction between the top and bottom plates 81 and 82 frictionally clamps the backing material 68 into this position above the female hoop portion 7. The backing material 68 will then be secured along with the portion of the garment to be embroidered between the female and male hoop portions 6 and 7 when the female hoop portion 7 receives the male hoop portion 6.

It is to be understood that the friction forces imposed upon the backing material 68 by the top and bottom plates 81 and 82 could be derived from a spring biasing means coupled between the top and bottom plates 81 and 82, rather than the above-described magnetic source.

Another feature of the base plate 30 illustrated in FIGS. 1 and 5 is that the lateral and longitudinal dimensions of the cantilever portion 32 and the aligning portion 31 are such that a sleeve of a garment to be embroidered such as a jacket or a golf shirt, can be positioned thereon.

Figure 4:
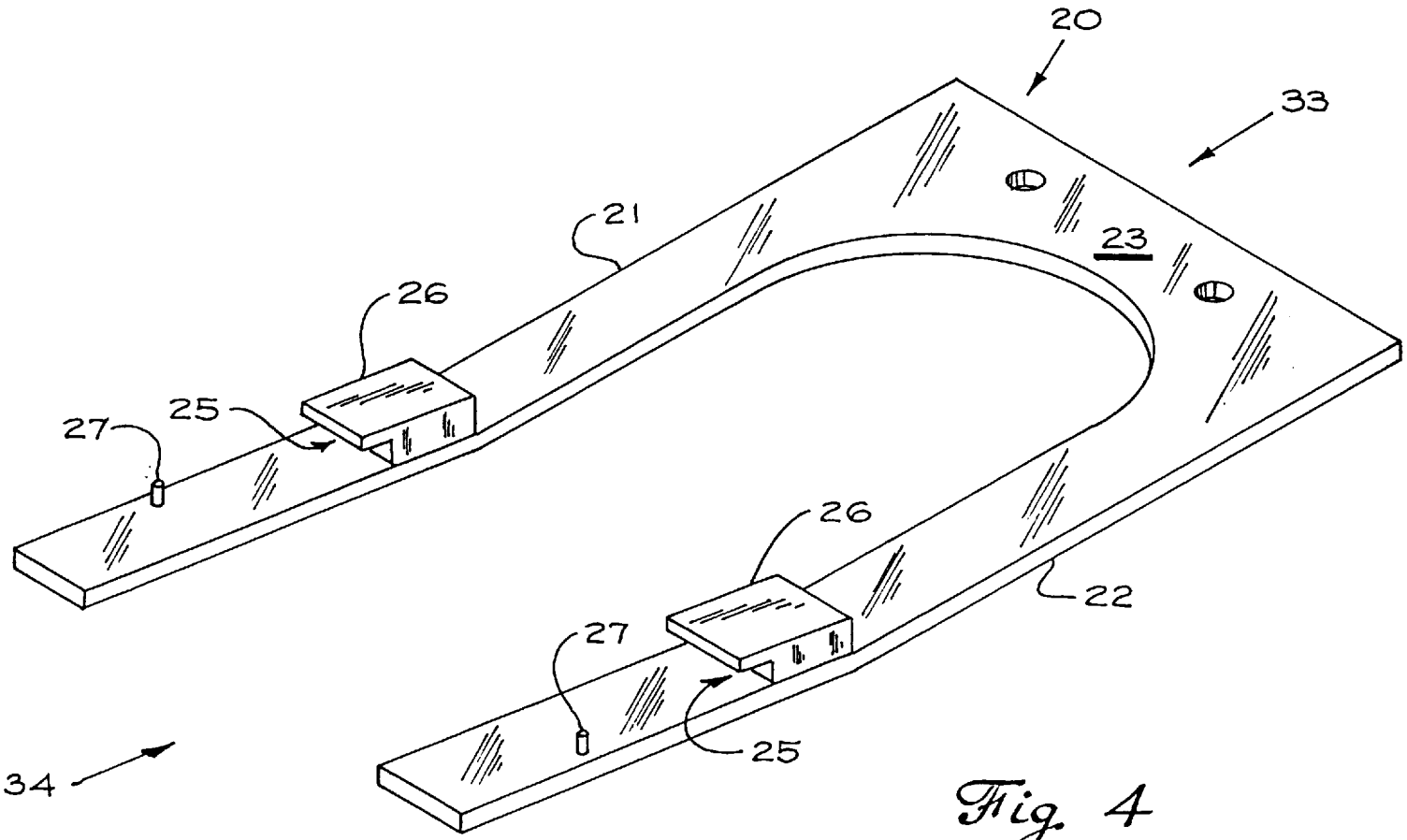
FIG. 4 is a view of the flexible arms that hold the male portion of the hoop device for the purpose of aligning the male portion with a complementary female portion of the hoop.

The aligning arm 20 illustrated in FIGS. 1 and 4 is designed to accurately seat the male hoop portion 6 within the female hoop portion 7. The aligning arm is comprised of a first finger 21 and a second finger 22 connected at their proximate ends by a web 23. The aligning arm 20 is supported above the aligning portion 31 at the web 23 upon a spacer 24. Both the spacer 24 and the aligning arm 20 are secured to the support structure 40 by bolts 35, though it is to be understood that bolts 35 may secure the aligning arm 20 and the spacer 24 to the aligning portion 31 only. Nuts 39 are threaded upon bolts 35 to secure the aligning arm 20, spacer 24, and aligning portion 31 to the cantilever portion 32. The fingers 21 and 22 of the aligning arm 20 extend from the web 23 generally parallel to the aligning portion 31. However, to facilitate the positioning of garments upon the base plate 30, the distal ends of fingers 21 and 22 may be biased away from aligning portion 31. In the embodiment of FIGS. 1 and 4, it is preferred to fabricate the aligning arm 20 from a polycarbonate material, though it is to be understood that any material possessing similar structural characteristics could be employed.

Means for repeatably and accurately positioning a male hoop portion 6 upon the distal end 34 of the fingers 21 and 22 of the aligning arm 20 are illustrated in FIGS. 1 and 4 and consist of a pair of positioning blocks 26, one mounted on each of the fingers 21 and 22 and a pair of positioning pins 27 located distal to the positioning blocks 26. The positioning blocks 26 form a slot 25 on each finger 21 and 22 capable of receiving an edge 6*a* of the male hoop portion 6. The positioning pins 27 are located on the fingers 21 and 22 so as to mate with corresponding holes 9 (FIG. 2) drilled through the male hoop portion 6. As can be seen from FIG. 1, the location of the positioning pins 27 can vary so long as the positioning pins 27 mate with holes 9 of the male hoop portion 6. The complementary action of the slots 25 and the positioning pins 27 serve to positively locate the male hoop portion 6 upon the fingers 21 and 22 of the aligning arm 20. Once the male hoop portion 6 has been releasably located upon the aligning arm 20, the aligning arm 20, which is resiliently biased away from the aligning portion 31, is forced downward towards the aligning portion 31, causing the male hoop portion to be received by the female hoop portion 7. The positioning blocks 26 and the positioning pins 27 are carefully arranged in predetermined locations so as to permit the repeated and accurate mating of the male and female hoop portions 6 and 7. In addition, it is important to fashion the aligning arm from a material having a proper modulus of elasticity such that the aligning arm 20 will be rigid enough to maintain the generally parallel relationship with the aligning portion 31 regardless of whether the male hoop portion 6 as been located upon the fingers 21 and 22 of the aligning arm 20 and will also be resilient enough to deflect under pressure so as to bring the male and female hoop portions 6 and 7 into mating contact.

While the present embodiment of the aligning arm 20 includes positioning pins 27, it is to be understood that a variety of equivalent positioning structures 27 can be employed. One such equivalent positioning structure may be a positioning peg having a rectangular shape that is receivable by a rectangular opening in an alternate male hoop portion 6. It is to be understood that the specific shape and the location upon the fingers 21 and 22 of the aligning arm of the positioning structures 27 can vary without exceeding the scope of the instant invention. The specific geometry of the positioning structure 27 is designed to mate with the varying designs of the male hoop portion 6 utilized by the various manufacturers of embroidery machines. Though the general structure of all male hoop portions 6 utilized by the various manufacturers of embroidery machines are essentially the same, the holes 9, the connecting brackets 10, and the edges 6*a* of the male hoop portions 6 may vary significantly. These differences may require the use of different aligning portions 31 with different aligning arms 20 with male and female hoop portions 6 and 7 from different manufactures.

An alternate embodiment of the aligning arm 20 is comprised of an aligning arm 20 affixed directly to the aligning portion 31, the spacer 24 being omitted. In this embodiment, the alternate aligning arm 20 would be bent close to its proximate end so as to bring the distal end of the aligning arm 20 into the generally parallel relationship with the base plate 30 pictured in FIG. 1.

Yet another embodiment of the aligning arm 20 is comprised of a substantially rigid aligning arm 20 hinged to a spacer 24, or in the alternative, directly to the base plate 30. This hinged aligning arm 20 would be arranged to bring the male hoop portion 6 into mating contact with the female hoop portion 7, while providing the added benefit of being able to swing the aligning arm 20 out of the way as the garment to be embroidered is positioned over the female hoop portion 7.

Figure 2:
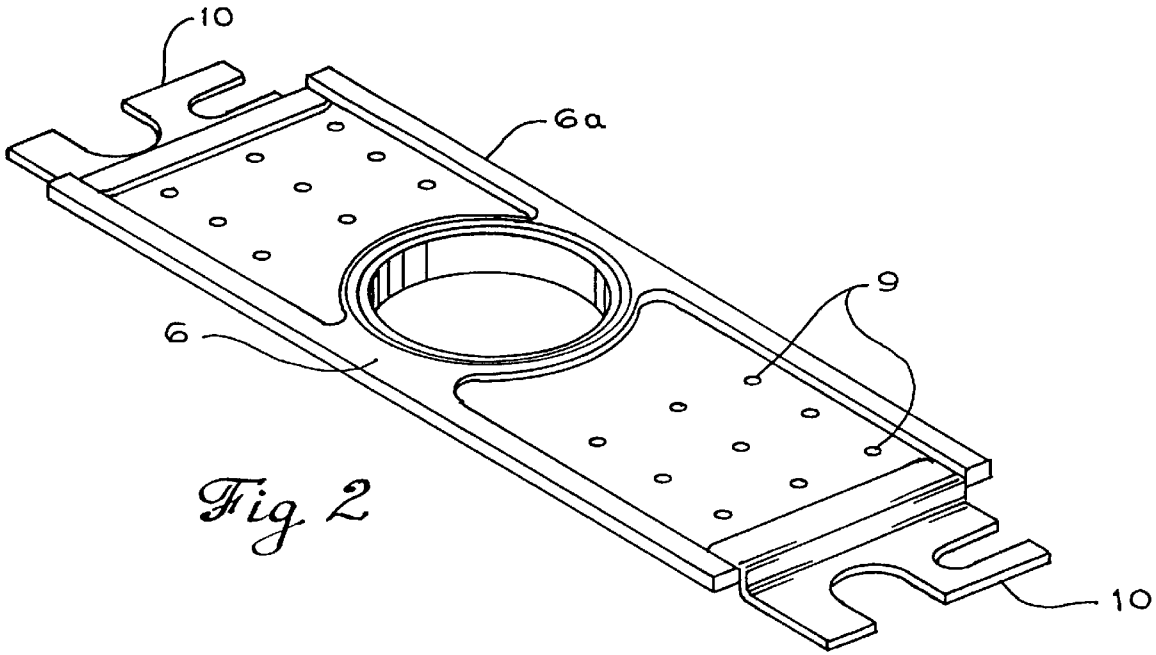
FIG. 2 is a male portion of a typical tubular hoop designed for mounting in an embroidery machine.

The above-described embodiments of the present invention are particularly well suited for the hooping of the sleeves of garments and other tubular items, though any portion of most any garment can be hooped upon this embodiment. The cantilevered base plate 30 readily accepts a sleeve of a garment to be embroidered without causing the sleeve to become bunched up, thereby preventing undesirable wrinkles in the portion of the fabric to be secured within the male and female hoop portions 6 and 7. The method of using these embodiments comprises the steps of placing a suitably sized female hoop portion 7 in the keyed recess 37, opening the location means 80 by rotating the top plates 82 away from the bottom plates 81, placing the backing material 68 over the keyed recess 37, and securing the backing material 68 in place by closing the location means 80 upon the backing material 68 by rotating the top plates 82 into physical contact with the backing material 68 and into magnetic contact with the bottom plates 81. Once the backing material 68 is in place, the portion of the garment to be embroidered is positioned over the keyed recess 37 with the desired portion being framed by the female hoop portion 7. When the garment is in its predetermined position, the male hoop ring 6 is releasably inserted into the slots 25 of the positioning blocks 26 such that positioning pins 27 mate with holes 9. The operator of the tubular hooping device 15 then forces the male hoop portion 6 into mating contact with the female hoop portion 7, thereby securing the portion of the garment to be embroidered and the backing material 68 between the male and female hoop portions 6 and 7. The hooped garment is removed from the tubular hooping device 15 and is mounted upon an embroidery machine by means of the connecting brackets 10 (FIG. 2).

When using varying sizes of hoops, it may be necessary to alter the diameter of the keyed recess 37. When the required hoop diameter is smaller than the keyed recess 37 and where the geometry of the male hoop portion 6 excepting the hoop diameter remains constant, smaller diameter hoops can be accommodated by placing inserts into keyed recess 37 and second recess 37*a*. But when the required hoops are larger than the keyed recess 37 and second recess 37*a* it will be necessary to use a base plate 30 having a larger keyed recess 37 and second recess 37*a*. Likewise, if the geometry of the male hoop portion 6 is such that the male hoop portion 6 is not capable of being received by the slots 25 and positioning pins 27 of fingers 21 and 22, it will be necessary to use an aligning arm 20 having slots 25 and positioning structures 27 of the appropriate geometry.

Figure 6:
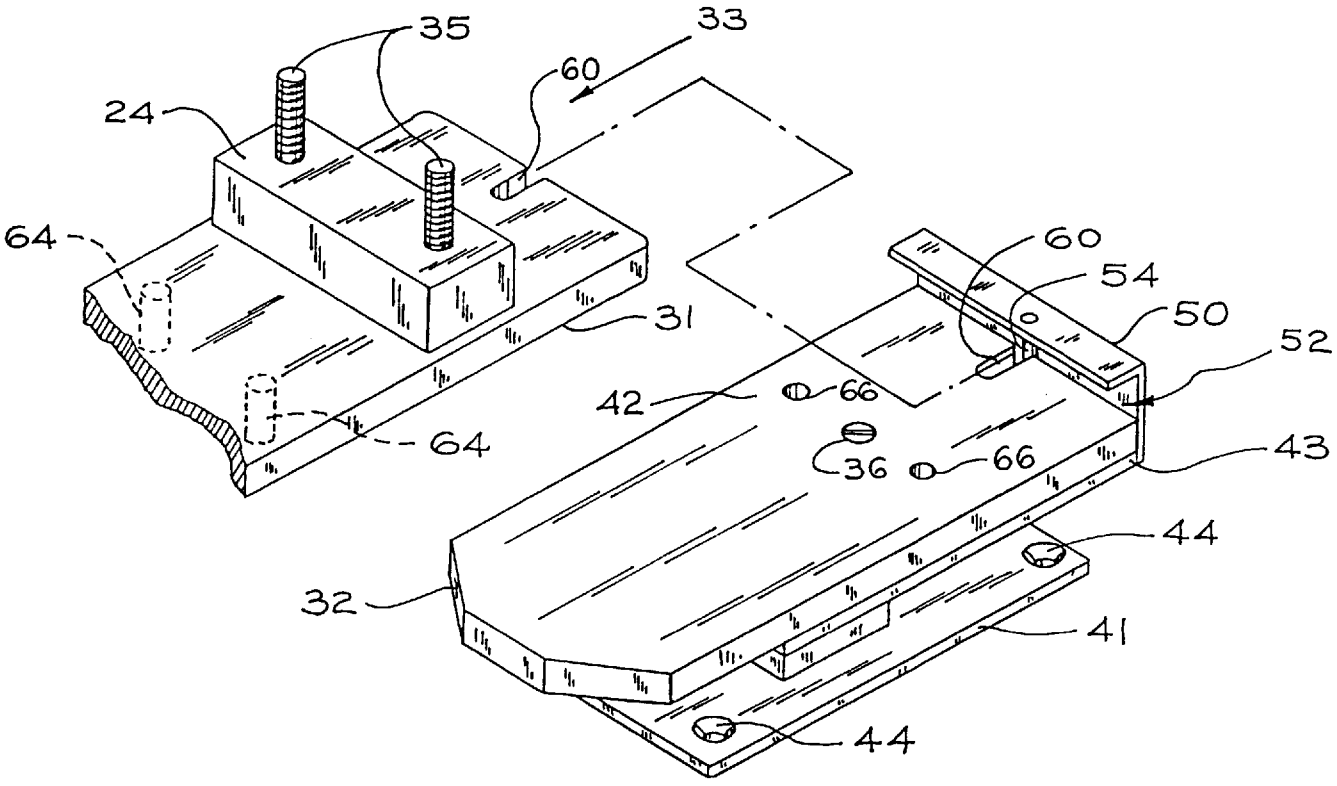
FIG. 6 is an exploded view of an alternate embodiment of the base plate and the support structure.

An alternate embodiment of the tubular hooping device is illustrated in FIG. 6. In this alternate embodiment, the support structure 40 is comprised of a bottom plate 41 and a top plate 43 affixed to opposite ends of a support pillar. The bottom plate is connected to the work surface 5 in the same manner as bracket 42. The top plate 43 has an angle iron 50 affixed to the proximate end 33 of the top plate 43 so as to form slot 52. Located in the central portion of the angle iron 50 and extending downward into the steel bracket 42, spaced away from the back of the slot 52, is slot pin 54. In this embodiment, the aligning portion 31 and cantilever portion 32 each have a base slot 60 that receives the slot pin 54 as the proximate ends 33 of the aligning and cantilever portions 31 and 32 are inserted into the slot 52. The cantilever portion 32 of the base plate 30 is secured to the support structure 40 by countersunk machine screw 36. Aligning portion 31 is removably secured to the cantilever portion 32 by pins 64 that extend downward from the bottom surface of the aligning portion 31. Pins 64 mate with aligning holes 66 formed into the surface of the cantilever portion 32. The pins 64 cooperate with the slot 52 formed by the angle iron 50 in that the base slot 60 receives the pin 54, thereby securing the proximate end 33 of the aligning portion 31 within the slot 52 while at the same time the aligning pins 64 are received in the aligning holes 66 of the cantilever portion. In this manner the aligning portion 31 is securely held on the cantilever portion 32 that is in turn secured to the support structure 40. Furthermore, as the aligning portion 31 is not positively secured to the cantilever portion 32, this arrangement permits the aligning portion 31 to be quickly removed and replaced by another aligning portion 31 that is more suitable to the hoop portions 6 and 7 that will be used with the hooping device 15.

In an alternative embodiment of the embodiment illustrated in FIG. 6, the angle iron 50 attached to the support structure 40 is arranged such that slot 52 may receive the cantilever portion 32 only. The cantilever portion 32 is secured to the support structure 40 by means of machine screw 36 and slot 52. The proximate end 33 of the cantilever portion 32 is received in the slot 52 with base slot 60 of the cantilever portion 60 being in concurrent receipt of the slot pin 54. The machine screw 36 positively secures the cantilever portion 32 to the support structure 40. The portion of the aligning portion 31 extending proximate to the spacer 24, this portion including the base slot 60 in FIG. 6, is omitted. In this alternative embodiment, the aligning portion 31 is removably secured to the cantilever portion by means of the locating pins 64 extending from the underside of the aligning portion 31 alone. The locating pins 64 of the aligning portion 31 are received in the holes 66 formed into the upper surface of the cantilever portion 32. This embodiment allows the user of the instant invention to very quickly exchange a particular aligning portion 31 for another.

An alternate embodiment of the aligning portion 31 has the keyed recess 37 machined into, but not through, the surface of the aligning portion 31. Coaxial to the keyed recess 37 and formed into the aligning portion 31 is an opening 37*b*. The opening 37*b* is smaller than the keyed recess 37 and permits a male hoop portion 6 to be inserted into and beyond the female hoop portion 7 while retaining the female hoop portion 7 in the same manner as does the second recess 37*a* described above. This alternate embodiment of the aligning portion 31 is interchangeable with other aligning portions 31 having locating pins 64 arranged to mate with the locating holes 66 of a cantilever portion 32 that is more or less permanently attached to the support structure. This alternate embodiment may be mounted upon a hooping rack 70 as described immediately below.

Figure 7:
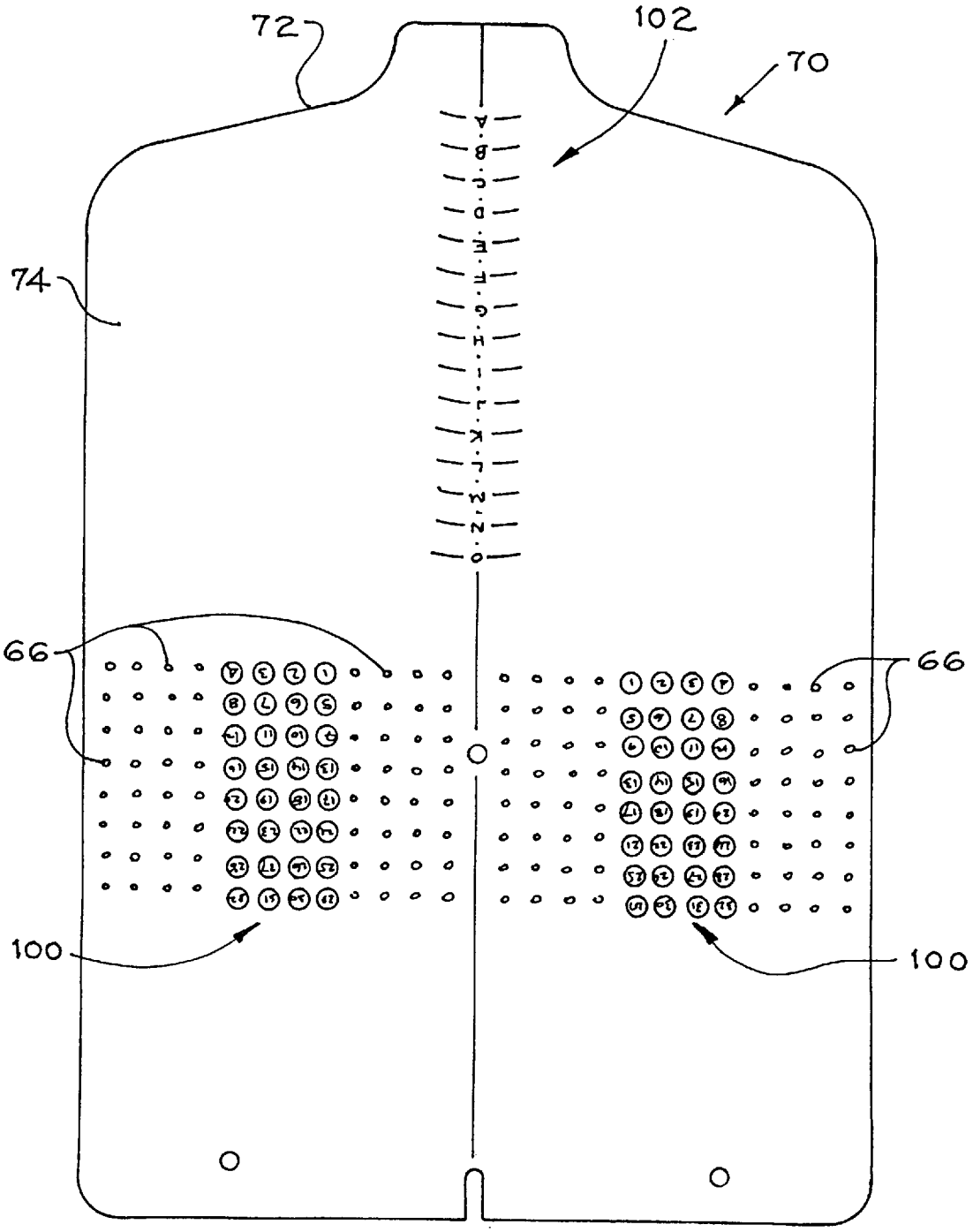
FIG. 7 is a perspective view of a hooping rack having locating holes, registration numerals, and registration letters arranged thereon.

An embodiment of the present invention more suited to hooping the fronts and backs of shirts and jackets is illustrated in FIG. 7 and described below. In this second embodiment, the cantilever portion 32 is replaced with a hooping rack 70 that may be arranged to be supported cantilever-fashion upon a support base 40 such as that illustrated in FIG. 6 or an equivalent thereof. The hooping rack 70 generally consists of a garment locating means 72 that may approximate the shape of a person's shoulders or a coat hanger mounted to the top of a flat board 74 having numerous aligning holes 66 formed therein.

The preferred structure for attaching the aligning portion 31 to the rack 70 for purposes of hooping garments to be embroidered comprises an aligning pin or pins 64 (see FIG. 6) which extend from the bottom of the aligning portion 31. These aligning pins 64 are received in the aligning holes 66 of the flat board 74. This arrangement provides a means whereby the keyed recess 37 and opening 37*b* of the aligning portion 31 may be secured in a predetermined position with the aligning arm 20 extending upward, i.e. towards the garment locating means 72, to allow the male hoop portion 6 to be accurately seated within the female hoop portion 7. As a means of further securing the aligning portion 31 to the flat board 74, a machine screw 36 may be provided in the base plate 30 in a known manner.

Because garments vary in dimension and because customers may so wish it, it is very important to be able to accurately position male and female hoop portions 6 and 7 of a tubular hoop. As can be derived from the preceding description, it is possible to accurately and positively locate the tubular hooping device 15 in number of predetermined positions upon the hooping rack 70. The aligning portion 31 having the aligning arm 20 attached thereto, is used with the hooping rack 70 in much the same way as the aligning portion 31 is used with the embodiment illustrated in FIG. 1, excepting that the aligning portion 31 is attached to the flat board 74 rather than the cantilever portion 32 and that the aligning portion 31 maybe attached to the flat board 74 in a number of predetermined positions. The process begins by locating the aligning portion 31 upon the flat board 74 in a predetermined position by means of the aligning pins 64 and aligning holes 66. A female hoop portion 7 is placed in the keyed recess 37 of the aligning portion 31 and a piece of backing material 38 is secured over the female hoop portion 7 using the location means 80. The garment to be embroidered is then placed upon the hooping rack 70 and a male hoop portion is placed upon the aligning arm 20 as described above. The male and female hoop portions 6 and 7 are pressed together to secure therebetween the portion of the garment that will be embroidered. This procedure is quickly repeatable and yields results that are both more accurate and more precise than other known methods and devices for hooping garments.

Novel features of the hooping rack 70 of FIG. 7 are the registration numerals 100 and the registration letters 102. Each of the registration numerals 100 correspond to a particular set of holes 66, which in turn each represent a particular location at which the aligning portion 31 may be attached to the hooping rack 70. Using the registration numerals 100, a user of the instant invention can readily locate the aligning portion 31 in a predetermined position upon the hooping rack. The registration letters 102 are used in conjunction with the registration numerals 100 to ensure that each garment to be embroidered is arranged upon the hooping rack 70 in the same manner as the previous garment to be embroidered. By noting the combination of the registration numeral 100 and registration letter 102 used to hoop a garment to be embroidered, the user of the instant invention can easily reproduce the hooping results achieved with the first garment.

Using the present invention with the hooping rack, the user may also be assured that garments having distinct patterns and shirt pockets will be accurately and precisely hooped. In order to ensure that the horizontal or vertical pattern of a garment is aligned with the embroidery, the garment is placed upon the hooping rack 70 such that the area of the garment to be embroidered is generally located over the female hoop portion 7 received in the base plate 30. A straight edge device 90 (not shown) that may be substantially transparent is securely received on the aligning arm 20 by means of the slots 25 and positioning pins 27 of the aligning arm 20. The straight edge device 90 may be as simple as a ruler arranged to be received upon the aligning arm 20. Registration lines 92 for showing horizontal and vertical lines and possibly a few angles are clearly printed upon the straight edge device 90. By viewing the pattern of the garment in relation to the registration marks 92 of the straight edge device 90, the user can quickly and accurately determine whether the embroidery will be aligned with the pattern of the garment. Furthermore, the registration lines 92 of the straight edge device 90 may also be numbered for use a ruler. The numbering of the registration lines 92 begins at an origin that is substantially in the center of the straight edge device 90 with the numbering of the registration lines 92 proceeding away from the origin. It is preferred that the origin of the straight edge device mark the center of the female hoop portion, which coincides with the center of the portion of the garment to be embroidered. This numbering arrangement allows a user to quickly determine whether a pocket is centered over the female hoop portion 7 received in the base plate 30 of the tubular hooping device 15. To determine whether the pocket is centered the user will look at the edges of the pocket through the straight edge device 90 to determine whether the edges of the pocket are the same distance from the origin of the registration lines 92.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A tubular hooping device for accurately and precisely seating a male hoop portion within a female hoop portion and securing therebetween a portion of fabric to be embroidered and a portion of backing material, the device comprising:

a base plate having a proximal end and a distal end and a top side and a bottom side, the base plate further being comprised of a cantilever portion and an aligning portion, the cantilever portion being arranged to removably support upon its upper surface the aligning portion;

a keyed recess sized to receive a female hoop portion, the keyed recess being formed into the top side of the distal end of the aligning portion of the base plate;

a second recess sized to receive a male hoop portion, the second recess being formed into the aligning portion coaxial with the keyed recess in the top side of the aligning portion of the base plate such that the male hoop portion received within the female hoop portion will also be received into the second recess, the second recess further being sized so as to prevent the ingress of the female hoop portion;

at least one location means situated upon the aligning portion adjacent the keyed recess; and an aligning arm supported above the base plate, the aligning arm having a proximate end and a distal end, the aligning arm being further comprised of a first finger and a second finger, the first finger and the second finger being joined at the proximate end of the aligning arm by a web, the aligning arm being coupled to the proximate end of the aligning portion of the base plate at the web, the first finger and the second finger each being provided at their distal end with a positioning block arranged so as to form a slot on the distal side of the positioning block, each finger further being provided with a positioning structure mounted distal to each positioning block, the positioning block and the positioning structure capable of engaging an edge of a male hoop portion so as to removably secure the male hoop portion to the aligning arm whereby the male hoop portion may be brought into mating contact with the female hoop portion without removing the male hoop portion from the aligning arm.

2. The tubular hooping device of claim 1 further comprising a support structure having a bottom and a top, the bottom of the support structure being secured to a work surface, the bottom side of the cantilever portion of the base plate being removably secured to the top of the support structure.

3. The tubular hooping device of claim 2 wherein an angle iron affixed to the proximate end of the top of the support structure forms a first slot capable of receiving the proximate end of the cantilever portion of the base plate, and wherein the cantilever portion of the base plate further has a base slot formed into the center of its proximate end to receive a slot pin that is affixed to the support structure between the angle iron and the top of the support structure when the proximate end of the cantilever portion is received by the first slot, the cantilever portion of the base plate being removably and positively secured to the top of the support structure by the first slot and by a machine screw passed through the base plate and threadedly received by a hole in the top of the support structure, the aligning portion of the base plate being removably secured to the upper surface of the cantilever portion by at least two aligning pins, the aligning pins being affixed to and depending from the lower surface of the aligning portion, the aligning pins of the aligning portion being received in at least two aligning holes formed into the upper surface of the cantilever portion.

4. The tubular hooping device of claim 1 further comprising a support structure having a bottom and a top, the bottom of the support structure being secured to a work surface, the top surface being arranged to support a hooping rack, the hooping rack having a plurality of aligning holes bored into the surface thereof in a plurality of predetermined positions, the aligning holes being arranged to receive at least two aligning pins extending from the bottom side of the aligning portion so as to permit the aligning portion to be positioned in any of the plurality of predetermined positions defined by the aligning holes.

5. A tubular hooping device for accurately and precisely seating a male hoop portion within a female hoop portion and securing therebetween a portion of fabric to be embroidered and a portion of backing material, the device comprising:

a base plate having a proximate end and a distal end and a top side and a bottom side;

a keyed recess sized to receive a female hoop portion, the keyed recess being formed into the top side of the distal end of the base plate;

a second recess sized to receive a male hoop portion, the second recess being positioned coaxial with the keyed recess and formed into the top side of the base plate such that the male hoop portion received within the female hoop portion will also be received into the second recess, the second recess further being sized so as to prevent the ingress of the female hoop portion; and an aligning arm supported above the base plate, the aligning arm having a proximate end and a distal end, the aligning arm being further comprised of a first finger and a second finger, the first finger and the second finger being joined at the proximate end of the aligning arm by a web, the aligning arm being coupled to the proximate end of the base plate at the web, the first finger and the second finger each being provided at their distal end with a positioning block arranged so as to form a slot on the distal side of the positioning block, each finger further being provided with a positioning structure mounted distal to each positioning block, the positioning block and the positioning structure capable of engaging an edge of a male hoop portion so as to removably secure the male hoop portion to the aligning arm whereby the male hoop portion may be brought into mating contact with the female hoop portion without removing the male hoop portion from the aligning arm.

6. The tubular hooping device of claim 5 further comprising a support structure comprising a bottom and a top, the bottom of the support structure being secured to a work surface, the bottom side of the base plate being removably secured to the top of the support structure.

7. The tubular hooping device of claim 5 further comprising a locating means, the locating means being comprised of:

a bottom plate affixed to the base plate immediately adjacent the keyed recess;

a top plate hinged to the bottom plate along a substantially linear first edge of each plate, the first edge of each plate being located away from the keyed recess;

each plate further having a second edge, the profiles of the second edges of each plate being substantially identical to each other and to a profile of the edge of the keyed recess, the second edges of the top and the bottom plates being substantially collinear with the edge of the keyed recess and;

the bottom plate and the top plate being magnetically attractive with each other such that a portion of backing material may be retained between the bottom plate and the top plate by friction forces created by the magnetic forces holding the top plate to the bottom plate when the plates are rotated towards one another.

8. The tubular hooping device of claim 5 further comprising a locating means, the locating means being comprised of:

a bottom plate affixed to the base plate immediately adjacent the keyed recess;

a top plate hinged to the bottom plate along a substantially linear first edge of each plate, the first edge of each plate being located away from the keyed recess;

each plate further having a second edge, the profiles of the second edges of each plate being substantially identical to each other and to a profile of the edge of the keyed recess, the second edges of the top and the bottom plates being substantially collinear with the edge of the keyed recess, and;

the bottom plate and the top plate being biased into contact with one another by a spring means coupled between the bottom plate and the top plate such that a portion of backing material may be retained between the bottom plate and the top plate by friction forces created by the spring means holding the top plate to the bottom plate.

9. A method for properly aligning a portion of a garment to be embroidered between a male hoop portion and a female hoop portion, the method comprising the steps of:

placing a female hoop portion in a keyed recess of an aligning portion of a tubular hooping device;

securing a portion of backing material over the female hoop portion received in the keyed recess of the aligning portion using at least one location means, the location means being affixed to the aligning portion immediately adjacent the keyed recess;

arranging the portion of the garment to be embroidered over the female hoop portion;

mounting a straight edge device upon an aligning arm of the tubular hooping device, the straight edge device being arranged to point out the center of the female hoop portion and to create a vertical and a horizontal reference against which a user of the tubular hooping device can compare the alignment of the portion of the garment to be embroidered;

adjusting the portion of the garment to be embroidered over the female hoop portion to a position in which the portion of the garment to be embroidered is properly centered with respect to the center point indicated by the straight edge device and aligned with the horizontal and the vertical references of the straight edge device;

removing the straight edge device from the aligning arm of the tubular hooping device;

mounting a male hoop portion upon the aligning arm of the tubular hooping device; and applying pressure upon the male hoop portion so as to securely seat the male hoop portion within the female hoop portion, thereby capturing the portion of the garment to be embroidered and the portion of backing material between the male hoop portion and the female hoop portion, the portion of the garment to be embroidered being properly centered and aligned within the male and female hoop portions.

10. The method of claim 9 wherein the locating means comprises:

a bottom plate affixed to the base plate immediately adjacent the keyed recess;

a top plate hinged to the bottom plate along a substantially linear first edge of each plate, the first edge of each plate being located away from the keyed recess;

each plate further having a second edge, the profiles of the second edges of each plate being substantially identical to each other and to the profile of the keyed recess, the second edges of the top and the bottom plates being substantially collinear with the edge of the keyed recess, and;

the bottom plate and the top plate being magnetically attractive with each other such that a portion of backing material may be retained between the bottom plate and the top plate by friction forces created by the magnetic forces holding the top plate to the bottom plate when the plates are rotated towards one another.

11. The method for properly aligning a portion of a garment to be embroidered between a male hoop portion and a female hoop portion of claim 9 wherein aligning portion is mounted upon a hooping rack, the hooping rack further having a plurality of registration numerals arranged adjacent a plurality of aligning holes so as to identify a set of at least two aligning holes that define a predetermined position for the aligning portion upon the hooping rack, the registration numerals working in conjunction with a plurality of registration letters arranged upon the hooping rack so as to indicate the location at which a garment is to be arranged upon the hooping rack.

12. A straight edge device for determining whether a portion of a garment to be embroidered is centered within a male and a female hoop portion and for determining whether the portion of the garment to be embroidered is properly aligned within the male and the female hoop portion, the straight edge device comprising:

a substantially flat rectangular body, having two linear parallel longitudinal sides, and a first end and a second end;

means for mounting the body of the straight edge device upon an aligning arm of a tubular hooping device, the means comprising an edge capable of being received in a slot formed by at least one aligning block, the at least one aligning block being affixed to an aligning arm of a tubular hoop device, and at least one hole, the hole being arranged to receive at least one positioning structure, the at least one positioning structure being affixed to the aligning arm distal to the aligning blocks, and;

a plurality of registration marks inscribed upon the body of the straight edge device, at least one registration mark indicating the location of the center of the portion of the garment to be embroidered, at least one other registration mark creating a horizontal reference and at least one other registration mark creating a vertical reference, the center, horizontal, and vertical references being used to determine whether the portion of a garment to be embroidered is properly aligned.

* * * * *